US011462395B1

(12) United States Patent
Liu et al.

(10) Patent No.: US 11,462,395 B1
(45) Date of Patent: Oct. 4, 2022

(54) METHOD FOR ON-ORBIT CALIBRATION OF BASIC PARAMETERS OF MASS SPECTROMETER

(71) Applicant: Institute of Geology and Geophysics, Chinese Academy of Sciences, Beijing (CN)

(72) Inventors: Ziheng Liu, Beijing (CN); Jiannan Li, Beijing (CN); Fei Su, Beijing (CN); Huaiyu He, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/716,090

(22) Filed: Apr. 8, 2022

(30) Foreign Application Priority Data

Jul. 7, 2021 (CN) ..... 202110766464.3

(51) Int. Cl.
*H01J 49/04* (2006.01)
*H01J 49/00* (2006.01)

(52) U.S. Cl.
CPC ..... *H01J 49/0422* (2013.01); *H01J 49/0009* (2013.01); *H01J 49/0468* (2013.01)

(58) Field of Classification Search
CPC . H01J 49/0422; H01J 49/0009; H01J 49/0468
See application file for complete search history.

(56) References Cited

U.S. PATENT DOCUMENTS

| | | | | |
|---|---|---|---|---|
| 6,646,253 | B1 * | 11/2003 | Rohwer | H01J 49/0422 239/3 |
| 10,796,894 | B2 * | 10/2020 | Trimpin | H01J 49/10 |
| 11,133,165 | B1 * | 9/2021 | Ragland | G01N 33/386 |
| 2003/0042458 | A1 * | 3/2003 | Rohwer | F16K 31/0658 251/318 |
| 2014/0166875 | A1 * | 6/2014 | Trimpin | H01J 49/04 250/288 |
| 2021/0356376 | A1 * | 11/2021 | Closson | H01J 49/0418 |

* cited by examiner

*Primary Examiner* — David A Vanore
(74) *Attorney, Agent, or Firm* — Porter Wright Morris & Arthur LLP

(57) ABSTRACT

The present disclosure relates to the technical field of calibration of basic parameters of mass spectrometers, and provides a method for on-orbit calibration of basic parameters of a mass spectrometer. Based on the characteristic that a molten silicate mineral can adsorb a gas in an environment, under vacuum conditions, a silicate mineral is heated to obtain the molten silicate mineral. The molten silicate mineral is put in an environment with a standard gas for adsorption, rapid cooling is conducted to obtain a standard sample, and the standard sample is preloaded into a thermal control device of the mass spectrometer. When the mass spectrometer enters a definitive orbit for testing a substance, on-orbit heating is conducted on the standard sample to make the adsorbed standard gas released into the mass spectrometer so as to achieve the calibration of the basic parameters of the mass spectrometer.

11 Claims, No Drawings

METHOD FOR ON-ORBIT CALIBRATION OF BASIC PARAMETERS OF MASS SPECTROMETER

CROSS REFERENCE TO RELATED APPLICATION(S)

This patent application claims the benefit and priority of Chinese Patent Application No. 202110766464.3, filed on Jul. 7, 2021, the disclosure of which is incorporated by reference herein in its entirety as part of the present application.

TECHNICAL FIELD

The present disclosure relates to the technical field of calibration of basic parameters of mass spectrometers, and in particular to a method for on-orbit calibration of basic parameters of a mass spectrometer.

BACKGROUND ART

A mass spectrometer is a scientific analysis instrument commonly used in deep space exploration. Before scientific analysis, indicators such as mass axis, resolution and sensitivity of the mass spectrometer need to be calibrated. According to a traditional method, a standard gas cylinder is usually carried and connected to the mass spectrometer through two valves, and then performance parameters of the mass spectrometer are calibrated.

The calibration method above has two shortcomings. First, the gas cylinder has a risk of on-orbit gas leakage, and if the gas cylinder leaks, calibration cannot be completed. Second, in order to improve the reliability of the instrument, the valves and the gas cylinder are designed to be heavy. However, the mass spectrometer needs to be sent into a definitive orbit by a rocket, so that the rocket launch cost is undoubtedly increased.

Therefore, it is urgent to provide a low-cost method for on-orbit calibration of basic parameters of a mass spectrometer.

SUMMARY

In view of this situation, an objective of the present disclosure is to provide a method for on-orbit calibration of basic parameters of a mass spectrometer. According to the calibration method provided in the present disclosure, a standard gas cylinder and valves matched with the standard gas cylinder are not required to be carried, so that a risk of on-orbit gas leakage of the gas cylinder is avoided, the weight of the mass spectrometer during the on-orbit calibration is reduced, and therefore, the rocket launch cost is reduced.

To achieve the above objective, the present disclosure provides the following technical solutions.

The present disclosure provides a method for on-orbit calibration of basic parameters of a mass spectrometer. The method includes the following steps:

(1) under vacuum conditions, heating a silicate mineral to obtain a molten silicate mineral;

(2) putting the molten silicate mineral obtained in step (1) in an environment with a standard gas for adsorption, and conducting rapid cooling to obtain a standard sample, where, the rapid cooling in step (2) is conducted at a rate of 50-200° C./min; and (3) preloading the standard sample obtained in step (2) into a thermal control device of the mass spectrometer, and conducting on-orbit heating to make the adsorbed standard gas released into the mass spectrometer so as to achieve on-orbit calibration of the basic parameters of the mass spectrometer.

Preferably, the silicate mineral in step (1) includes pyroxene and/or fayalite.

Preferably, the silicate mineral is the fayalite.

Preferably, the silicate mineral in step (1) has a particle size of not less than 50 mesh.

Preferably, the heating in step (1) is conducted under vacuum conditions.

Preferably, the vacuum has a vacuum degree of no more than 0.00001 Pa.

Preferably, the standard gas in step (2) is a rare gas.

Preferably, the rare gas includes helium and xenon.

Preferably, the on-orbit heating in step (3) is conducted at a temperature of not lower than 600° C.

Preferably, the on-orbit heating in step (3) is conducted for at least 10 min.

Preferably, the basic parameters in step (3) include mass axis, resolution and sensitivity.

The present disclosure provides a method for on-orbit calibration of basic parameters of a mass spectrometer. The method includes the following steps: under vacuum conditions, heating a silicate mineral to obtain a molten silicate mineral; putting the molten silicate mineral in an environment with a standard gas for adsorption, and conducting rapid cooling to obtain a standard sample; and preloading the obtained standard sample into a thermal control device of the mass spectrometer, and conducting on-orbit heating to make the adsorbed standard gas released into the mass spectrometer so as to achieve on-orbit calibration of the basic parameters of the mass spectrometer. In the present disclosure, based on the characteristic that the molten silicate mineral can adsorb the gas in the environment, the silicate mineral is heated to obtain the molten silicate mineral. The molten silicate mineral is put in the environment with the standard gas for the adsorption, the rapid cooling is conducted to obtain the standard sample, and the standard sample is preloaded into the thermal control device of the mass spectrometer. When the mass spectrometer enters a definitive orbit for testing a substance, the on-orbit heating is conducted on the standard sample to make the adsorbed standard gas released into the mass spectrometer so as to achieve the calibration of the basic parameters of the mass spectrometer. As the silicate mineral cannot release the gas before the heating, the risk of gas leakage caused by using the standard gas cylinder is avoided. In addition, the valves matched with the gas cylinder are not required, so that the weight of the mass spectrometer is reduced, and therefore, the rocket launch cost is reduced.

DETAILED DESCRIPTION OF THE EMBODIMENTS

The present disclosure provides a method for on-orbit calibration of basic parameters of a mass spectrometer. The method includes the following steps:

(1) under vacuum conditions, a silicate mineral is heated to obtain a molten silicate mineral;

(2) the molten silicate mineral obtained in step (1) is put in an environment with a standard gas for adsorption, and rapid cooling is conducted to obtain a standard sample, where, the rapid cooling in step (2) is conducted at a rate of 50-200° C./min; and (3) the standard sample obtained in step (2) is preloaded into a thermal control device of the mass spectrometer, and on-orbit heating is conducted to make the adsorbed standard gas released into the mass spectrometer so as to achieve on-orbit calibration of the basic parameters of the mass spectrometer.

In the present disclosure, under vacuum conditions, the silicate mineral is heated to obtain the molten silicate mineral.

In the present disclosure, the silicate mineral preferably includes pyroxene and/or fayalite, and is preferably the fayalite. In the present disclosure, based on the characteristic that the molten silicate mineral can adsorb the gas in the environment, the silicate mineral is used as a carrier for the standard gas. In the present disclosure, the fayalite with a relatively low melting point is preferably used as the carrier for the standard gas.

In the present disclosure, the silicate mineral has a particle size of not less than 50 mesh. In the present disclosure, the particle size of the silicate mineral is limited to the range above, so that increase of a melting rate of the silicate mineral is facilitated.

In the present disclosure, the vacuum preferably has a vacuum degree of no more than 0.00001 Pa. In the present disclosure, the heating is conducted under vacuum conditions so that the molten silicate mineral can be prevented from adsorbing other gases in the environment in advance. When the vacuum degree is controlled within the range above, an adsorption effect on the standard gas is great.

In the present disclosure, there are no special requirements on a heating temperature, as long as the silicate mineral can be melted. In the present disclosure, the heating temperature is controlled to melt the silicate mineral. Based on the characteristic that the molten silicate mineral can adsorb the gas in the environment, the silicate mineral is used as the carrier for the standard gas.

In the present disclosure, there are no special provisions on a heating device, as long as the required heating temperature and vacuum degree can be provided. In the present disclosure, there are no special provisions on a use amount of the silicate mineral, and the silicate mineral can be added in an amount allowed by the selected heating device.

The obtained molten silicate mineral is put in the environment with the standard gas for the adsorption, and the rapid cooling is conducted to obtain the standard sample. The rapid cooling is conducted at a rate of 50-200° C./min. In the present disclosure, the cooling rate is controlled within the range above so that the standard gas can be better carried in the silicate mineral.

In the present disclosure, preferably, under the conditions for preparing the molten silicate mineral, a standard gas is injected into a vacuum environment of the molten silicate mineral, so that the molten silicate mineral is put in the environment with the standard gas for the adsorption, and the rapid cooling is conducted to obtain the standard sample.

In the present disclosure, there are no special provisions on an injection method, and a gas introduction technical solution known to those skilled in the art can be used. In the present disclosure, a use amount of the standard gas is not particularly limited, as long as the molten silicate mineral can be in a standard gas atmosphere. In the present disclosure, the molten silicate mineral in the standard gas atmosphere can adsorb the standard gas.

In the present disclosure, the standard gas is preferably a rare gas, and more preferably includes helium and xenon. In the present disclosure, the rare gas with stable properties is used as the standard gas, which is unlikely to undergo a reaction during the calibration, so that the calibration stability is improved.

In the present disclosure, the helium with a mass number of 4 is preferably used. In the present disclosure, the xenon with a mass number of 132 and 129 is preferably used. In the present disclosure, the helium with a mass number of 4 and the xenon with a mass number of 132 are used so that the calibration in a range of 4-132 can be realized. The xenon with a mass number of 129 is used as a reference to measure the calibration accuracy.

In the present disclosure, the obtained standard sample is preloaded into the thermal control device of the mass spectrometer, and the on-orbit heating is conducted to make the adsorbed standard gas released into the mass spectrometer so as to achieve on-orbit calibration of the basic parameters of the mass spectrometer.

In the present disclosure, the on-orbit heating is preferably conducted at a temperature of not lower than 600° C. The on-orbit heating is preferably conducted for at least 10 min. In the present disclosure, the on-orbit heating is conducted on the prepared standard sample within the temperature and time ranges above by using the thermal control device of the mass spectrometer so that the standard gas in the standard sample can be completely released. The released standard gas directly enters the mass spectrometer to achieve the calibration of the basic parameters of the mass spectrometer.

In the present disclosure, the basic parameters preferably include mass axis, resolution and sensitivity.

In the present disclosure, there are no special provisions on a calibration method of the mass axis, the resolution and the sensitivity. A standard gas calibration method known to those skilled in the art can be used for calibration of the mass axis, the resolution and the sensitivity of the mass spectrometer.

In the present disclosure, based on the characteristic that the molten silicate mineral can adsorb the gas in the environment, under vacuum conditions, the silicate mineral is heated to obtain the molten silicate mineral. The molten silicate mineral is put in the environment with the standard gas for the adsorption, the rapid cooling is conducted to obtain the standard sample, and the standard sample is preloaded into the thermal control device of the mass spectrometer. When the mass spectrometer enters a definitive orbit for testing a substance, the on-orbit heating is conducted on the standard sample to make the adsorbed standard gas released into the mass spectrometer so as to achieve the calibration of the basic parameters of the mass spectrometer. As the silicate mineral cannot release the gas before heating, the risk of gas leakage caused by using a standard gas cylinder is avoided. In addition, valves matched with the gas cylinder are not required, so that the weight of the mass spectrometer is reduced, and therefore, the rocket launch cost is reduced.

The technical solutions in the present disclosure are clearly and completely described below in conjunction with examples of the present disclosure. It is clear that the described examples are merely a part, rather than all of the examples of the present disclosure. Based on the examples of the present disclosure, all other examples obtained by the person of ordinary skill in the art without creative efforts shall fall within the protection scope of the present disclosure.

Example 1

A fayalite powder (with a weight of 1.5 g and an average particle size of 60 mesh) was added into a vacuum high-temperature furnace with a vacuum degree controlled below 0.00001 Pa and heated at 1,300° C. to obtain molten fayalite. Under such temperature and pressure, a mixed gas of $^{4}He$, $^{132}Xe$ and $^{129}Xe$ was injected into the high-temperature furnace, then the furnace was rapidly cooled at a rate of 180° C./min to form solid fayalite, and a standard sample containing a standard gas was obtained. The standard sample was evenly divided into several parts. One part of the sample was used to analyze and determine the content of He and Xe in the standard sample, and other parts of the sample were used for calibration of mass axis, resolution and sensitivity of a mass spectrometer.

Calibration of the Mass Axis was as Follows.

0.25 g of the prepared standard sample was put into a thermal control device of the mass spectrometer and heated to 600° C. for 30 min by using the thermal control device. Gases $^{4}He$, $^{132}Xe$ and $^{129}Xe$ were released and then analyzed by using the mass spectrometer. During analysis, low-speed scanning from the lowest mass number to the highest mass number was adopted, and there were three peaks on a mass spectrum obtained after the analysis. When the three peaks were at positions with mass-to-charge ratios of 4, 129 and 132 respectively, the calibration was not needed. When the three peaks were not at corresponding positions, actual mass numbers and measured corresponding mass numbers of the standard gases $^{4}He$ and $^{132}Xe$ were substituted into a calibration formula $y=ax+b$ (the x referred to an actual mass number of a standard gas, the y referred to a mass number of the corresponding standard gas measured on the mass spectrum, and the a and the b referred to correction factors) to calculate the a and the b. Based on the obtained correction formula, the mass axis was calibrated. Test results of the $^{129}Xe$ were used to measure the accuracy of the calibrated mass axis.

Calibration of the Resolution was as Follows.

After the calibration of the mass axis, a peak width at 50% of a peak height of any one of the three peaks on the mass spectrum indicated the resolution of the mass spectrometer. Any one of the three peaks was selected, and a R value was calculated based on a formula $R=M/\Delta M$ (the M referred to a mass number of a standard gas shown on the mass spectrum, and the $\Delta M$ referred to a peak width at 50% of a peak height). When the R value was not less than the actual mass number of the standard gas corresponding to the selected peak, it was indicated that the operation of an instrument was normal, and on the contrary, the instrument was faulty or required to be adjusted. After a fault was corrected or the instrument was adjusted to be normal, a following test was conducted.

Calibration of the Sensitivity was as Follows.

The sensitivity of the mass spectrometer was calibrated based on a formula $\varphi=IV/CB*m$. $\varphi$ referred to a sensitivity. I referred to a current corresponding to an analyzed mass number of $^{4}He$, $^{132}Xe$ or $^{129}Xe$ in the standard sample. V referred to a volume of an analysis cavity of the calibrated mass spectrometer. CB referred to a content of $^{4}He$, $^{132}Xe$ or $^{129}Xe$ in the standard sample obtained by using any method in the prior art for determining the content of $^{4}He$, $^{132}Xe$ or $^{129}Xe$ in the same standard sample preloaded into the thermal control device of the mass spectrometer. The m referred to a mass of the standard sample preloaded into the thermal control device of the mass spectrometer.

In summary, according to the technical solutions provided in the present disclosure, as the standard gas is fixed into the silicate mineral, a standard gas cylinder and valves matched with the standard gas cylinder are not required to be used, so that a risk of on-orbit gas leakage of the gas cylinder is avoided, the weight of the mass spectrometer is reduced, and therefore, the rocket launch cost is reduced.

The above descriptions are merely preferred implementations of the present disclosure. It should be noted that those of ordinary skill in the art may further make several improvements and modifications without departing from the principle of the present disclosure, and such improvements and modifications should be deemed as falling within the protection scope of the present disclosure.

What is claimed is:

1. A method for on-orbit calibration of basic parameters of a mass spectrometer, comprising the following steps:

(1) under vacuum conditions, heating a silicate mineral to obtain a molten silicate mineral;

(2) putting the molten silicate mineral obtained in step (1) in an environment with a standard gas for adsorption, and conducting rapid cooling to obtain a standard sample, wherein, the rapid cooling in step (2) is conducted at a rate of 50-200° C./min; and (3) preloading the standard sample obtained in step (2) into a thermal control device of the mass spectrometer, and conducting on-orbit heating to make the adsorbed standard gas released into the mass spectrometer so as to achieve on-orbit calibration of the basic parameters of the mass spectrometer.

2. The method according to claim 1, wherein, the silicate mineral in step (1) comprises pyroxene and/or fayalite.

3. The method according to claim 2, wherein, the silicate mineral is the fayalite.

4. The method according to claim 2, wherein, the silicate mineral in step (1) has a particle size of not less than 50 mesh.

5. The method according to claim 1, wherein, the silicate mineral in step (1) has a particle size of not less than 50 mesh.

6. The method according to claim 1, wherein, the vacuum in step (1) has a vacuum degree of no more than 0.00001 Pa.

7. The method according to claim 1, wherein, the standard gas in step (2) is a rare gas.

8. The method according to claim 7, wherein, the rare gas comprises helium and xenon.

9. The method according to claim 1, wherein, the on-orbit heating in step (3) is conducted at a temperature of not lower than 600° C.

10. The method according to claim 1, wherein, the on-orbit heating in step (3) is conducted for at least 10 min.

11. The method according to claim 1, wherein, the basic parameters in step (3) comprise mass axis, resolution and sensitivity.

* * * * *